United States Patent [19]

Serbent et al.

[11] 4,308,055

[45] Dec. 29, 1981

[54] PROCESS OF BRIQUETTING SPONGE IRON-CONTAINING MATERIAL

[75] Inventors: Harry Serbent, Hanau; Horst Steinhöfel, Neu Anspach; Werner Kaas, Dinslaken, all of Fed. Rep. of Germany; Justus Kühn, deceased, late of Karben, Fed. Rep. of Germany, by Gisela Kühn, heir

[73] Assignee: Metallgesellschaft AG, Frankfurt, Fed. Rep. of Germany

[21] Appl. No.: 148,476

[22] Filed: May 9, 1980

[30] Foreign Application Priority Data

May 12, 1979 [DE] Fed. Rep. of Germany ..... 2919272

[51] Int. Cl.[3] ..... C22B 1/243

[52] U.S. Cl. ..... 75/3; 75/33; 75/44 R; 264/111

[58] Field of Search ..... 75/3-5, 75/44 R, 44 S, 33-39; 264/111

[56] References Cited

U.S. PATENT DOCUMENTS

| | | | |
|---|---|---|---|
| 933,269 | 9/1909 | Schumacher | 75/3 |
| 2,793,109 | 5/1957 | Huebler et al. | 75/3 |
| 3,556,772 | 1/1971 | Rausch et al. | 75/44 R |

OTHER PUBLICATIONS

Henderson, J. G. et al., *Metallurgical Dictionary*, Rheinhold, New York, N.Y. p. 239 (1953).

*Primary Examiner*—Michael L. Lewis

*Attorney, Agent, or Firm*—Sprung, Felfe, Horn, Lynch & Kramer

[57] ABSTRACT

An improved process for briquetting sponge iron-containing material wherein as binder there is employed dilute sulfuric acid and the sponge iron-containing material contains at least 40% by weight metallic iron.

6 Claims, No Drawings

PROCESS OF BRIQUETTING SPONGE IRON-CONTAINING MATERIAL

BACKGROUND OF THE INVENTION

1. Field of the Invention

This invention relates to a process of briquetting sponge iron-containing material which has been produced by direct reduction and is in a cooled state and contains a binder added before the material is briquetted.

2. Discussion of the Prior Art

Sponge iron-containing materials become available as a result of the direct reduction or waelz processing of materials which contain iron oxides by means of solid carbonaeous reducing agents or reducing gases in a rotary kiln, shaft furnace or retort furnace. Such materials may particularly consist of iron ores or of residual materials obtained in metallurgical operations. The material which contains sponge iron may be treated to remove other constitutents of the charge and is then processed to produce crude iron or steel. For that purpose the material may be charged to low shaft electric furnaces, blast furnaces or electric arc furnaces. Whereas such charges must have a particle size above are lower limit, the sponge iron-containing material which becomes available has in part or entirely a particle size below said lower limit. Additionally, the fines, which generally consist of particles below about 6 mm, are highly susceptible to atmospheric influences in storage and transit. It would be essential to avoid an exposure to water but this cannot always be ensured. Moreover, the handling of material which contains sponge iron, inclusive of a substantial proportion of fines always involves a disturbing raising of dust.

These disadvantages can be eliminated by a decrease of the surface area of the material. This can be accomplished by briquetting, which has been known for a long time. The resulting formation of larger lumps is also a requirement for the use of such materials in a blast furnace. Briquetting may be effected at high or low temperatures. It is desired to effect it at one heat, although this is not possible in many cases. In cold briquetting, the wear of tools depends highly on the pressure applied and this can be decreased by an addition of certain binders and by providing the required strength of the compact article by a subsequent age hardening. In the selection of the binders, their availability, price and proportioning properties, the age hardening time required and the behavior of the compact during the succeeding heat treatment must be taken into account. Known binders which are acceptable also from the cost aspect include lime, molasses, spent sulfite cooling liquor, bitumen and starch, although all of them require an age hardening for at least 24 hours. Some of them cause the compacts to disintegrate during the succeeding heat treatment.

German Pat. No. 1,071,733 discloses a process of cold-briquetting sponge iron-containing material without an addition of a binder. The briquette products are treated with $CO_2$ in the persence of moisture. The moist briquettes which contain $CO_2$ are then aged in the presence of an oxygen-containing gas. That process is expensive and takes considerable time.

It is known from German Pat. No. 1,270,054 to cool all matter discharged from the furnace in such a manner that a formation of martensite is substantially avoided, and then to briquette the material without a binder. In that process, a special cooling of the sponge iron-containing material is required.

From "Neues aus der Technik", Vogel-Verlag, Würzburg, 1977, No. 2, page 1, it is known that the matter discharged from a rotary kiln after waelz processing can be briquetted. Spent sulfite sooling liquor is added to the matter which has been discharged so that the solids of the spent sulfite amount to 2 to 5% of the matter which has been discharged. The mixture is aged and then briquetted. The briquettes are age-hardened at room temperature for at least 2 hours and preferable for 12 to 72 hours. That process requires ageing and age hardening steps.

From Austrian Pat. No. 221,588 and German Pat. Nos. 1,140,592 and 1,143,837 it is known that fine-grained ore, blast furnace flue dust or similar pulverulent materials which contain not more that 15% metallic iron in the form of a very fine powder can be briquetted after an addition of sulfuric acid and/or aqueous iron sulfate solutions. Thereafter, the briquettes are watered and subsequently age-hardened in the presence of air. An increase of the metallic iron content above 13% does not result in an appreciable improvement in strength and involves an inadequate initial strength. For this reason, pre-reduced ores which contain more metallic iron are mixed with other materials so that the mixture contains between 2% and about 10% of metallic iron.

It is an object of the invention to provide a process for the briquetting of sponge iron produced by a direct reduction so that the briquettes need not be after-treated before being charged to metallurgical furnaces.

SUMMARY OF THE INVENTION

This object is accomplished, according to the invention, by adding dilute sulfuric acid as a binder, the material to which the dilute sulfuric acid is added containing by weight more than 40% metallic iron. The term "dilute sulfuric acid" describes aqueous solutions which contain free sulfuric acid. The dilute sulfuric acid is suitably added before a mixing step.

In a preferred embodiment, the dilute sulfuric acid contains 10 to 30% by weight of free sulfuric acid. The use of concentrations in this range results in particularly good strength properties.

In a preferred embodiment, the dilute sulfuric acid is added in an amount of 3 to 15% by weight, preferably 5 to 10% be weight, based on dry matter. This proportion permits a good mixing with the material and results in good strength properties. In case of a high content of metallic iron, the proportion of dilute sulfuric acid which is added may be in the lower portion of the range stated.

In a preferred embodiment, waste sulfuric acid is used as dilute sulfuric acid. This permits an economical use of a waste product.

The invention will be explained more fully with reference to examples.

Briquettes were made with an addition of waste sulfuric acid obtained in the production of $TiO_2$. The pressure applied amounted to 5 metric tons per cm of the length of the rolls. The briquettes were pillow-shaped and had a weight of about 100 grams, a height of 23 mm, a width of 43 mm and a length of 46 mm. The waste acid had the following properties:

Specific gravity = 1.323 g/cm$^3$; 35.3° Bé

Free sulfuric acid content = 21.3% by weight.

The briquettes had the properties stated in the table.

Age hardening did not result in an appreciable improvement of the properties. Watering of the briquettes did not adversely affect their properties. This shows that the briquettes are highly resistant to atmospheric influences.

The advantages afforded by the invention reside in that the briquettes can be transported and charged to a metallurgical furnace or reactor withour further treatment or aging immediately after leaving the press. They have a high crushing strength and abrasion resistance. In addition, they are less susceptible to water and have a high dimensional stability during subsequent thermal processing.

| | Test No. | | | | | | | | | |
|---|---|---|---|---|---|---|---|---|---|---|
| | 1 | 2 | 3 | 4 | 5 | 6 | 7 | 8 | 9 | 10 |
| $Fe_{met}$, % | 22 | 35 | 46 | 60 | 46 | 46 | 46 | 46 | 46 | 46 |
| Sulfuric acid added, % | 8 | 8 | 8 | 8 | 8 | 1 | 3 | 6 | 8 | 12 |
| Age hardening, h | no | no | no | no | no | no | no | no | no | no |
| Watering, h | no | no | no | no | no | no | no | no | no | no |
| Crushing strength, kg/cm$^2$ | 90 | 150 | 450 | 650 | 470 | 30 | 200 | 380 | 460 | 430 |
| Dropping strength % whole briquettes | | | | | | | | | | |
| 1 × 2 m | 0 | 30 | 90 | 100 | 100 | 0 | 60 | 80 | 100 | 90 |
| 5 × 2 m | n.d.+ | 10 | 80 | 80 | 80 | — | 20 | 60 | 80 | 70 |

| | Test No. | | | | | | | | | |
|---|---|---|---|---|---|---|---|---|---|---|
| | 11 | 12 | 13 | 14 | 15 | 16 | 17 | 18 | 19 | 20 |
| $Fe_{met}$, % | 46 | 46 | 46 | 46 | 46 | 46 | 46 | 46 | 46 | 46 |
| Sulfuric acid added, % | 15 | 18 | 20 | 8 | 8 | 8 | 8 | 8 | 8 | 8 |
| Age hardening, h | no | no | no | 4 | 8 | 24 | no | no | no | no |
| Watering | no | no | no | no | no | no | 4 | 8 | 24 | 336 |
| Crushing strength kg/cm$^2$ | 350 | 200 | 180 | 500 | 480 | 520 | 420 | 460 | 400 | 410 |
| Dropping strength % whole briquettes | | | | | | | | | | |
| 1 × 2 m | 80 | 50 | 30 | 100 | 100 | 100 | 100 | 100 | 100 | 100 |
| 5 × 2 m | 60 | 10 | 0 | 90 | 90 | 90 | 90 | 90 | 90 | 90 |

+not determined

What is claimed is:

1. In a process of briquetting sponge iron-containing material which has been produced by direct reduction and is in a cooled state and contains a binder added before the material is briquetted, the improvement wherein dilute sulfuric acid is added as a binder and the material to which said dilute sulfuric acid is added contains more than 40% metallic iron.

2. A process according to claim 1, wherein the dilute sulfuric acid contains 10 to 30% by weight of free sulfuric acid.

3. A process according to claim 1, wherein the dilute sulfuric acid is added in an amount of 3 to 15% by weight, based on dry matter.

4. A process according to claim 1, wherein waste sulfuric acid is used as dilute sulfuric acid.

5. A process according to claim 1, wherein the dilute sulfuric acid is added in an amount of 5 to 10% by weight, based on dry matter.

6. A process according to claim 1, wherein the briquette is thereafter charged to a metallurgical furnace without intermittent treatment or aging before being charged to said metallurgical furnace.

* * * * *